US009951563B2

(12) United States Patent
Beaton et al.

(10) Patent No.: US 9,951,563 B2
(45) Date of Patent: Apr. 24, 2018

(54) WELLBORE MILL HAVING SHEAR CUTTERS AND GOUGING CUTTERS

(71) Applicant: Shear Bits, Ltd., Calgary (CA)

(72) Inventors: Timothy P. Beaton, Calgary (CA); Ryan J. C. Marley, Airdrie (CA); Alex Wong, Calgary (CA); John James Herman, Cypress County (CA); Carl M. Hoffmaster, Houston, TX (US); Kenneth M. Nevlud, Tomball, TX (US)

(73) Assignee: Shear Bits, Ltd., Calgary, AB (CA)

( * ) Notice: Subject to any disclaimer, the term of this patent is extended or adjusted under 35 U.S.C. 154(b) by 264 days.

(21) Appl. No.: 14/813,206

(22) Filed: Jul. 30, 2015

(65) Prior Publication Data

US 2016/0265281 A1 Sep. 15, 2016

Related U.S. Application Data

(60) Provisional application No. 62/129,984, filed on Mar. 9, 2015.

(51) Int. Cl.

| | |
|---|---|
| ***E21B 10/26*** | (2006.01) |
| ***E21B 10/42*** | (2006.01) |
| ***E21B 10/08*** | (2006.01) |
| ***E21B 29/00*** | (2006.01) |
| ***E21B 10/55*** | (2006.01) |

(52) U.S. Cl.

CPC ..... *E21B 10/26* (2013.01); *E21B 10/08* (2013.01); *E21B 10/42* (2013.01); *E21B 10/55* (2013.01); *E21B 29/00* (2013.01)

(58) Field of Classification Search

CPC ..... E21B 10/28; E21B 10/26; E21B 10/42; E21B 10/43; E21B 10/52; E21B 10/55; E21B 10/56; E21B 10/561; E21B 10/5673; E21B 10/58; B24D 3/008

See application file for complete search history.

(56) References Cited

U.S. PATENT DOCUMENTS

| | | | | |
|---|---|---|---|---|
| 2012/0279785 | A1* | 11/2012 | Gavia | E21B 10/55 175/428 |
| 2014/0251594 | A1 | 9/2014 | Garcia et al. | |
| 2015/0030149 | A1 | 1/2015 | Chu et al. | |
| 2015/0060149 | A1 | 3/2015 | Herman et al. | |

OTHER PUBLICATIONS

Extended European Search Report of EP 161159468.4 dated Oct. 6, 2016.

* cited by examiner

*Primary Examiner* — Yong-Suk Ro
(74) *Attorney, Agent, or Firm* — Richard A. Fagin

(57) ABSTRACT

A mill includes a mill body defining a plurality of blades extending in a direction from a center or rotation of the mill body to a gauge surface. The blades define a cutting profile having a minimum diameter at a longitudinal endmost position. The minimum diameter is smaller than a diameter of a drop ball. The cutting profile has an intermediate diameter at most equal to the diameter of the drop ball at a longitudinal distance from the endmost position greater than the diameter of the drop ball. Shear cutters are mounted on at least one of the plurality of blades, mounted such that at least one shear cutter is mounted closer to a center of rotation of the mill body with respect to other cutters mounted to the blades. At least one insert is mounted to the at least one of the plurality of blades rotationally ahead of the shear cutters.

20 Claims, 6 Drawing Sheets

WELLBORE MILL HAVING SHEAR CUTTERS AND GOUGING CUTTERS

CROSS REFERENCE TO RELATED APPLICATIONS

Priority is claimed from U.S. Provisional Application No. 62/129,984 filed on Mar. 9, 2015.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable

BACKGROUND

This disclosure is related to the field of milling tools used to remove objects from a wellbore other than formations to be drilled. More particularly, the disclosure relates to mills that may be used in wellbores completed using multiple stage fracture treatments prior to configuring the wellbore for production as well as mills for scale removal/cleanouts, casing exits, etc.

In the process of fracture treatment of a well that penetrates a formation over an extended axial distance, the fracture treatment may be performed along separate axial intervals in successive stages. Various equipment is used to isolate each fracture treatment stage and that equipment creates restrictions inside the completed casing. In many cases, it is desirable to mill away the stage isolation equipment to allow as large a bore as possible (full casing/liner ID) to enhance hydrocarbon recovery. Up until very recently, most multiple stage fracture treatments included up to around 25 stages. The stage isolation equipment in such wellbores is typically milled out with either conventional junk mills (simple products with crushed carbide or sharp carbide inserts held in by weld), roller cone drill bits, and much less frequently with polycrystalline diamond compact (PDC) mills.

The foregoing milling operations are typically performed using an hydraulic motor deployed in the wellbore at the end of a coiled tubing. Such operations are also conducted with small, sometimes truck mounted rigs with conventional drill pipe as well Such milling operations are generally performed in small internal diameter well casings (e.g., 3.5 inches to-4.75 inches), and, therefore they use small diameters hydraulic motors that do not generate high torque. Stalling of such motors is very common and is a major concern when milling fracture stage isolation equipment as well as during other milling operations such as mills for scale removal/cleanouts, casing exits, etc. The inherent risk of motor stalling is one reason why junk mills and roller cone bits are preferred over PDC mills. Another reason the PDC cutter mills are not frequently used is that PDC cutters are often damaged because the materials used in the various parts of the fracture stage isolation equipment are of varying strength and are not consistently spaced within the cross-section of the interior of the wellbore casing. This results in high instantaneous loads on the mill, which may easily break PDC cutters.

In the process of milling out fracture stage isolation equipment it is important to the economics of the well that all the stage isolation equipment is milled in one milling operation, and such operation should be completed as quickly as possible. Therefore, using PDC mills known in the art, which are subject to damage as explained above, is not considered reliable. However, it has been observed that PDC mills can mill through the zone isolation equipment much faster than junk mills or roller cone bits. Roller cone bits generally work well, but due to the fact that most small diameter motors operate at a high RPM, and to the fact that small diameter roller cone bits have very small bearings, the rate of failure of seals & bearings on roller cones is relatively high. Roller cones are also a fairly expensive option for this type of work as they are a consumable (i.e., discarded after the run). Crushed carbide mills and PDC mills can be repaired, so the cost can be spread out over multiple operations to make the use of such mills more economical. Therefore, as with PDC mills, roller cone bits may not always be desirable due to the risk of premature failure.

More recently, multiple stage fracture treatment systems are being developed that include many more stages than using multiple stage systems known in the art. Such newer systems may include up to 100 stages in one lateral interval, and, in many cases, such systems include stage isolation devices that may use "drop balls" that are metallic, as contrasted with drop balls that are used in earlier multiple state fracturing systems made from composite materials. As a result, there is a need for a wellbore mill that can reliably and consistently mill wellbore devices and/or scale accumulation in one run, and complete such milling operation in an economically beneficial amount of time.

DETAILED DESCRIPTION

In various example embodiments of a mill according to the present disclosure, by placing one or more shaped inserts, for example, carbide gouging cutters, rotationally in front of shear cutters, for example, PDC cutters, the shear cutters may be protected from damage and allow the mill to function efficiently. In some example embodiments, shaped inserts or gouging cutters may be omitted from the radial center of the mill because the only equipment that needs to be milled in the center of a wellbore liner or casing is typically drop balls or soft materials such as elastomers or composites. Drop balls may have a much more consistent material cross section than other wellbore devices subject to milling, and therefore may result in more even loading on the mill. The evenness of the loading on the mill may be to an extent that the reliability of the shear cutters is not of concern. However, radially outwardly to the shoulder section of the mill, a mill according to the present disclosure may have shaped inserts rotationally in front of shear cutters as that part of the mill will be cutting through many different types of materials, including cast iron, and with a very interrupted cut.

There are two specific features of a mill according to the present disclosure that distinguish it structurally from a drill bit used to drill through rock formations.

First, the mill has a ballistic profile or longitudinally stepped profile instead of a cone profile (i.e., the centermost cutters are longitudinally ahead of cutters laterally displaced from the center of the mill instead of behind as in cone profiles). This type of profile does not work with formation drill bits because a cutter at the center of rotation extended axially outward from the rest of a formation drill bit would likely break as soon as the bit touched the bottom of the wellbore. In the case of a mill, however, there is typically nothing that the mill will be used to remove from the wellbore that is sufficiently hard to break the centermost cutter(s).

Second, the mill cutting structure does not extend all the way out to the gage of the mill (i.e., the gage pads define a slightly larger diameter than the rest of the cutting structure). Unlike drilling rock formations with an ordinary drill bit, fracture stage isolation and/or other wellbore equipment and materials to be milled are designed to crumble apart when milled. As a result, it is not necessary to have a cutting structure that extends all the way out to the full gage diameter of the mill. Further, by having no cutting structure at the maximum OD of the mill, the mill will be less likely to damage the interior wall (ID) of the wellbore pipe or casing.

Figure 1:
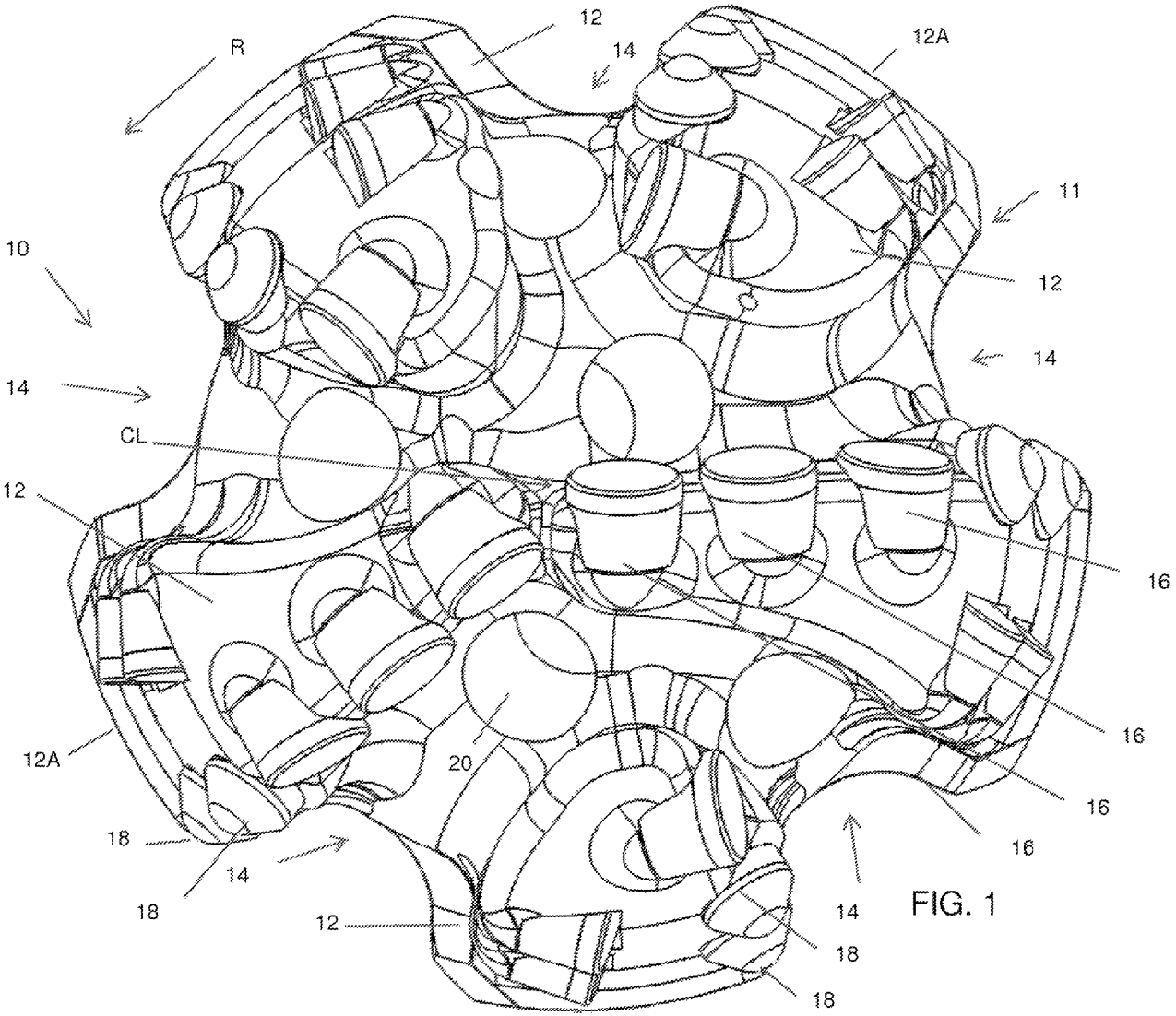
FIG. 1 shows an end view of an example mill according to the present disclosure.

FIG. 1 shows an end view of an example embodiment of a mill according to the present disclosure. The mill 10 may have a mill body 11 which defines at least one and in some embodiments a plurality of radially extending blades 12. The blades 12 may extend from a position proximate a center of rotation CL of the mill body 11 to a gage portion 12A defining a gage diameter or an outer diameter (OD) of the mill 10. An ordinary direction of rotation R is counterclockwise with reference to the view in FIG. 1. A space 14 disposed circumferentially between adjacent blades 12 may be defined as a junk slot.

On at least one, and in some embodiments all of the blades 12, are a plurality of shear cutters 16. The shear cutters 16 may be any type known to be used in fixed cutter drill bits, including but not limited to polycrystalline diamond compact (PDC) cutters, each of which includes a diamond table affixed to a substrate such as may be made from tungsten carbide or other carbide. Other ones of the shear cutters 16 may be made entirely from metal carbide, such as tungsten carbide or cubic boron nitride (CBN). The shear cutters 16 may be brazed or otherwise affixed to the respective blade(s) 12 by brazing or other attachment means known in the art. Rotationally ahead of the shear cutters 16 on each blade 12 having such cutters, may be disposed one or more hard material inserts 18, for example, gouging or pick type cutters. Gouging type cutters are used in drill bits for drilling mine shafts or tunnels, among other uses. Such bits are known in the art as "claw" bits, one example of which is sold under the trademark QUIKLAW, which is a trademark of Drillhead, Inc. The inserts 18 may be made from tungsten carbide or tungsten carbide coated steel, for example. The inserts 18 may have a generally conically shaped or pointed end and may be affixed to the mill body 11 using any attachment means known in the art. The exact shape of the inserts 18 may be different in other embodiments; the pointed or conical shape used in the present example is not intended to limit the scope of the present disclosure.

Figure 2:
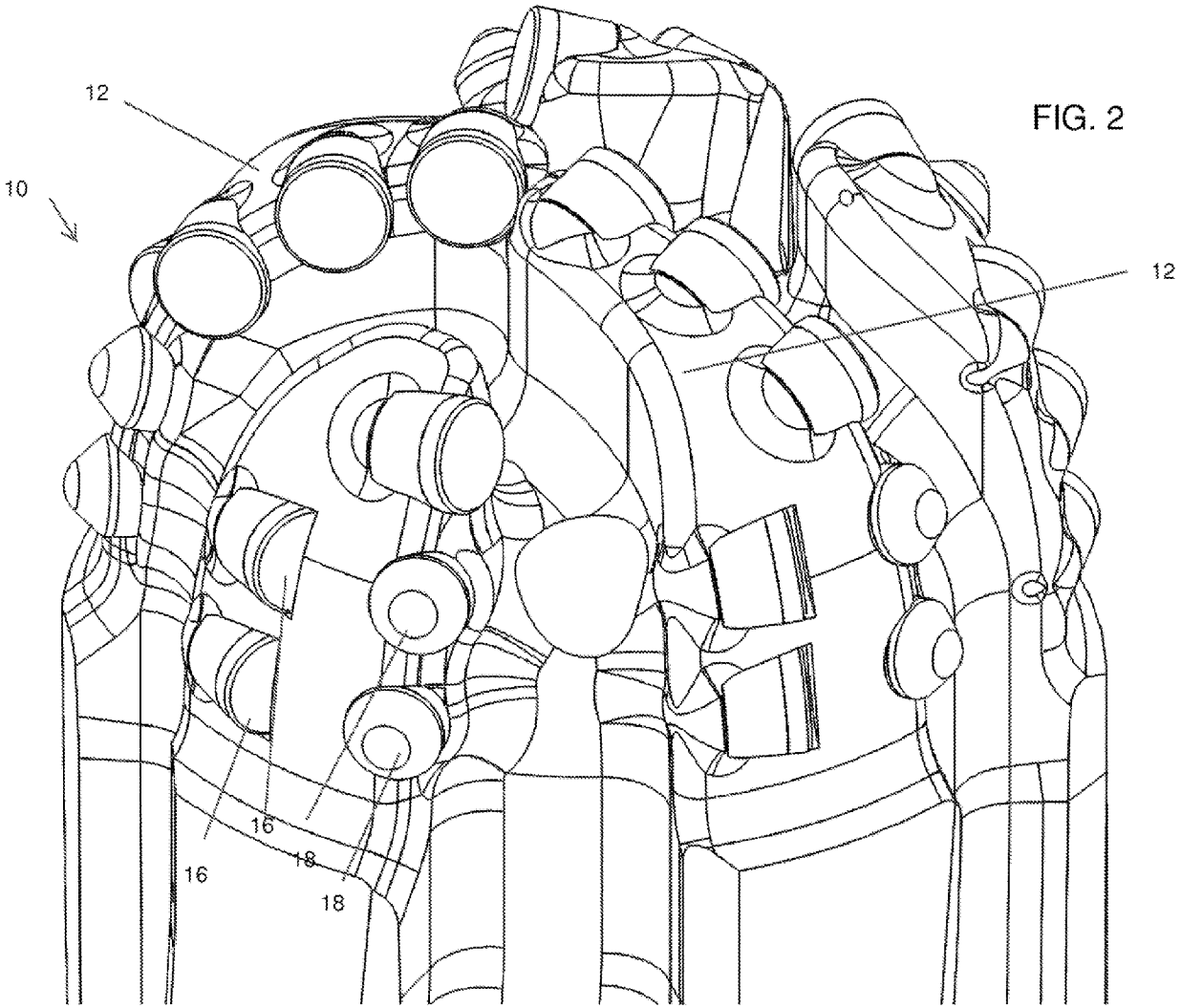
FIG. 2 shows an oblique view of the example mill of FIG. 1.

FIG. 2 shows an oblique view of the mill 10 shown in FIG. 1 to illustrate an example embodiment of a profile defined by the blades 12. The blades 12 in the present example embodiment may define a substantially ballistic profile, that is, the center of the profile extends longitudinally the greatest distance from the opposite end of the mill body (11 in FIG. 1). The shear cutters 16 may be observed in FIG. 2 as being affixed to at least one of the blades 12 close to the center of rotation (CL in FIG. 1), such that one or more of the shear cutters 16 extends longitudinally the greatest distance from the opposite end of the mill body (11 in FIG. 1). The inserts 18 are shown disposed rotationally ahead of the shear cutters 16. In the present example embodiment, as explained above, the maximum radial distance of any of the cutters 16 or inserts 18 may be at a position less than the full diameter defined by the blades out to the respective gage portions thereof (see 12A in FIG. 1).

Figure 3:
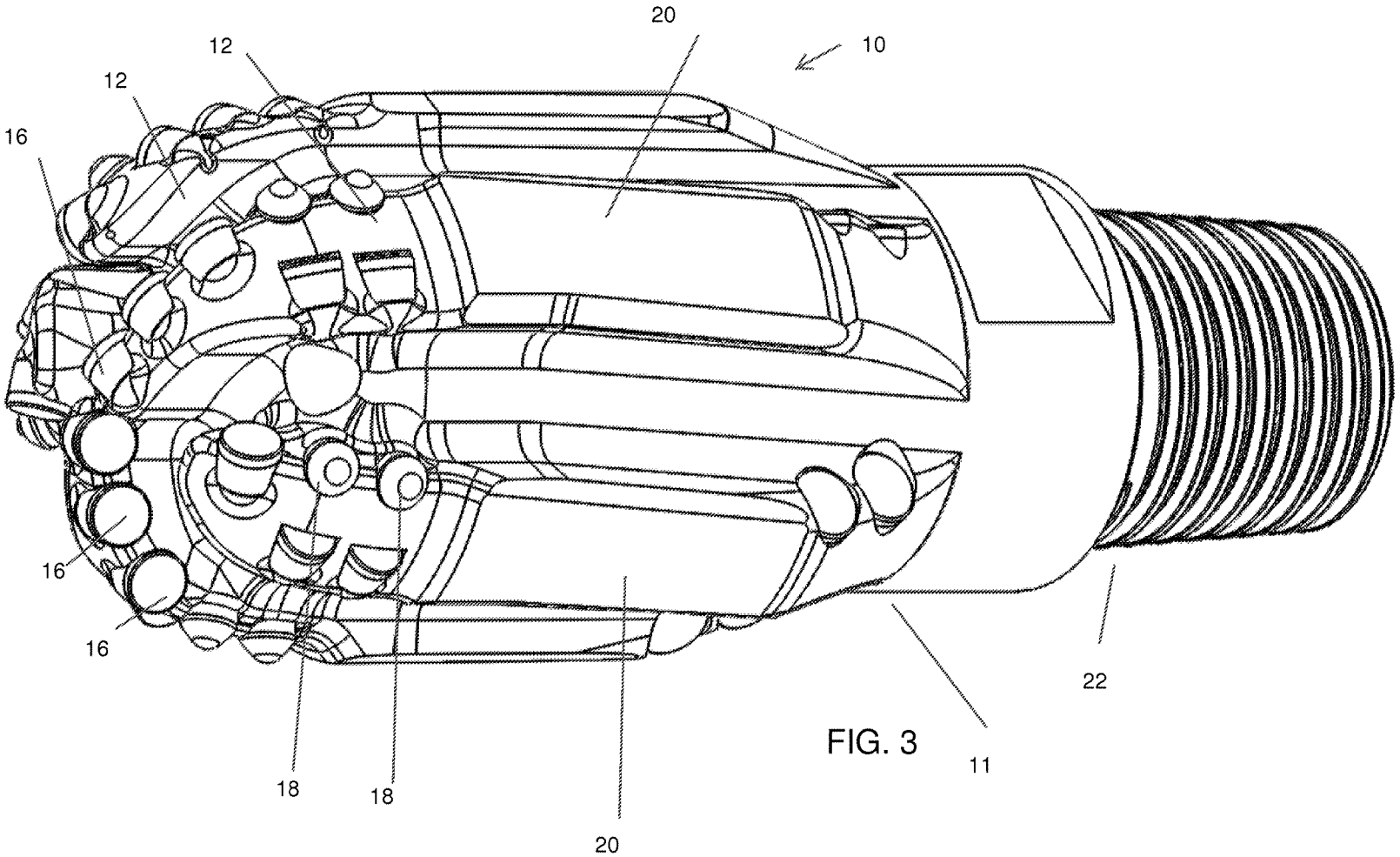
FIG. 3 shows a side view of an example mill.

A side view of the mill 10 shown in FIG. 3 illustrates the shear cutters 16, the inserts 18 and their relative positions on one or more of the blades 12. A gage face 20 may be formed in some or all of the blades 12. As explained above, the blades 12 define a substantially ballistic cutting profile, wherein one or more shear cutters 16 may be disposed closest to the center of rotation (CL in FIG. 1) and thus at a greatest longitudinal extent from the opposite end of the mill body 11. The mill body 11 may include a coupling 22, e.g., threads, for connection to a drilling motor or to a drill string.

Figure 4:
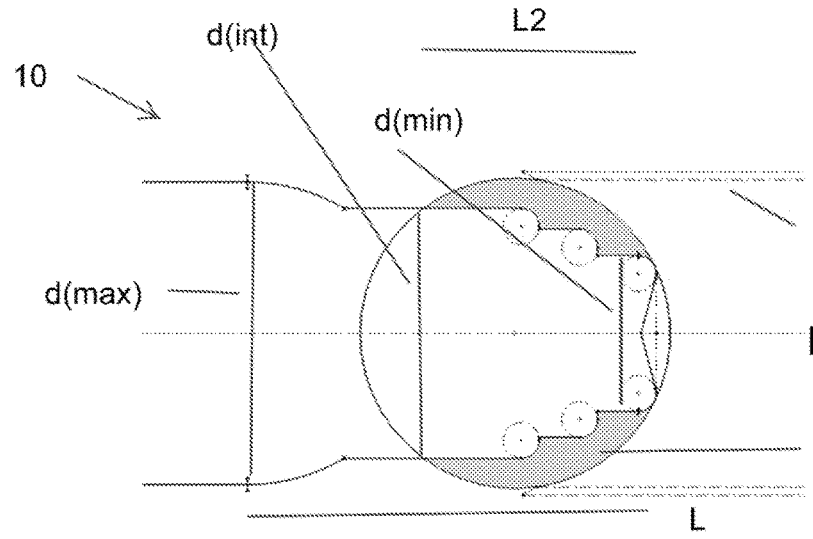
FIGS. 4 through 6 show an example embodiment of a mill penetrating a drop ball.

The example embodiment shown in FIGS. 2 and 3 has a substantially ballistic profile. Referring to FIG. 4, another type of profile that may be used in some embodiments may be a stepped profile having a minimum diameter d(min), and profile length L over which the effective diameter of the mill 10 increases from the minimum diameter d(min) to the full gage OD of the mill 10, shown as d(max) in FIG. 4. FIG. 4 illustrates the mill 10 beginning to penetrate a drop ball 30 disposed in a frac sleeve 32.

In the present example embodiment a maximum intermediate diameter d(int) defined by the profile is less than a diameter of the drop ball 30 and is at an axial position L2 from the axial end of the mill 10 such that the mill 10 will penetrate through the entire drop ball 30 before contacting any other portion of the interior of the pipe or casing, e.g., a ball seat for the drop ball 30. That is, the axial position L2 is at least equal to the diameter of the drop ball 30 and the intermediate diameter d(int) is smaller than the diameter of the drop ball.

Figure 7:
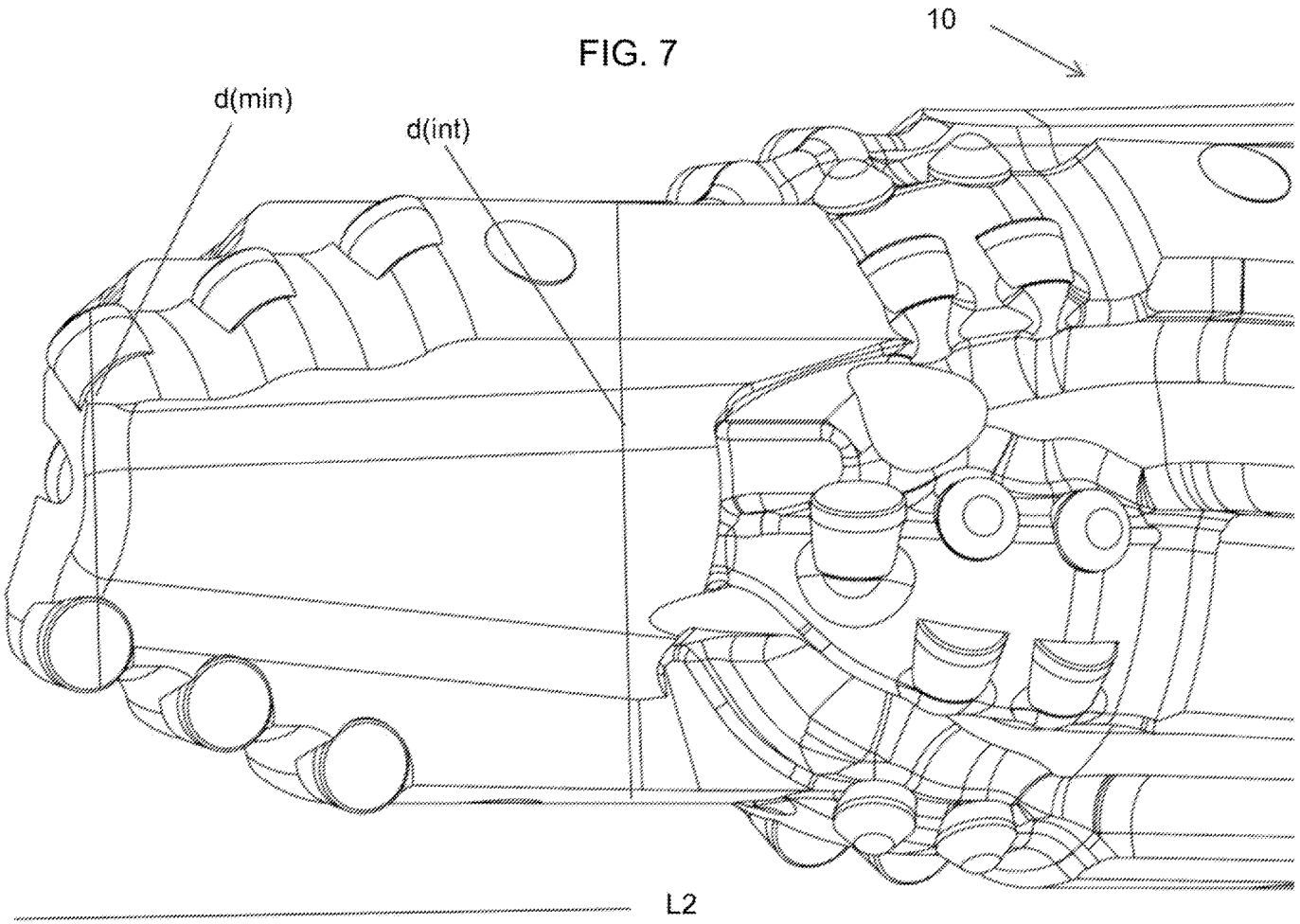
FIGS. 7 and 8 show example mills having a stepped diameter profile.
Figure 8:
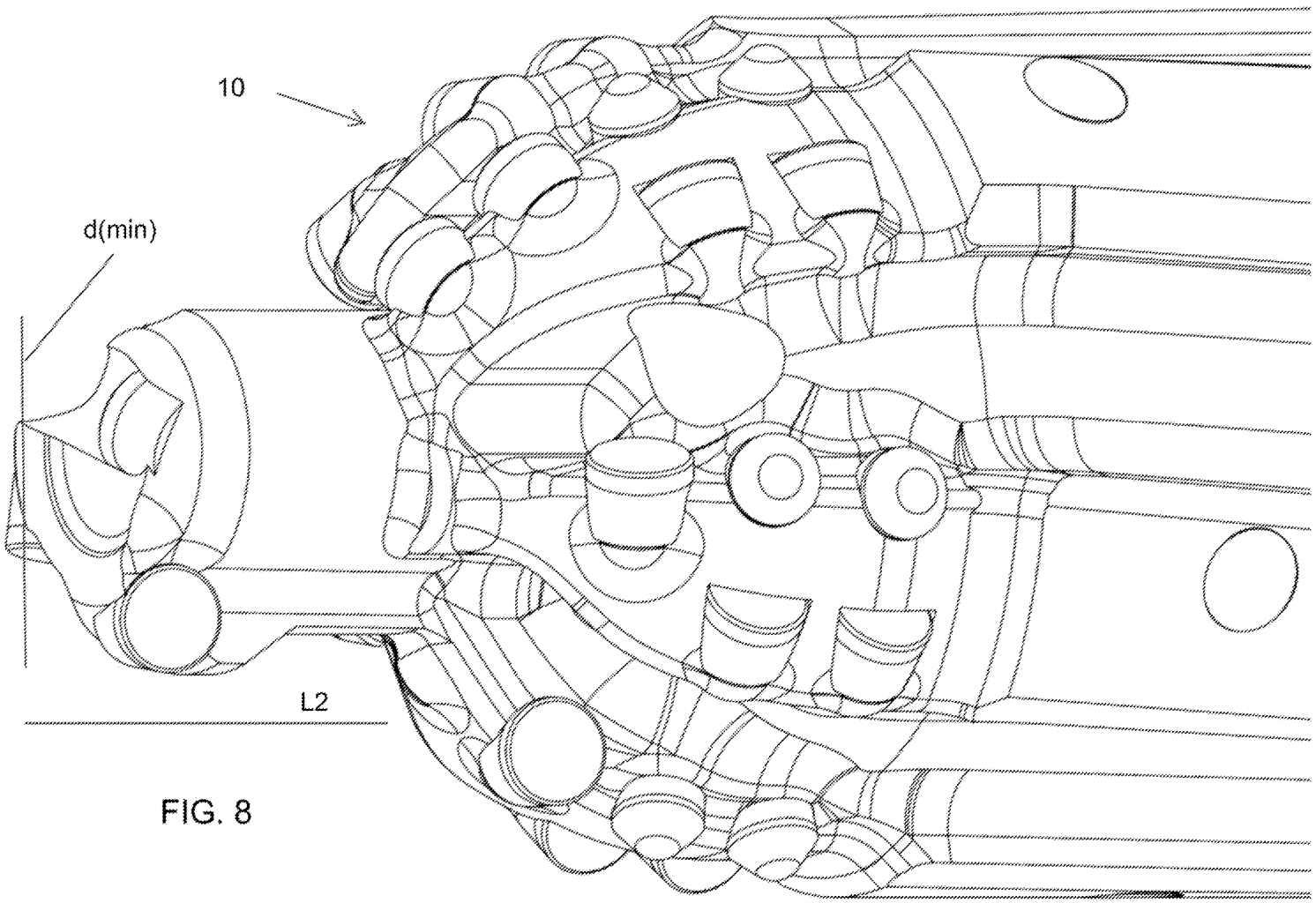

Examples of stepped profile mills according to the present disclosure are shown in oblique view in FIGS. 7 and 8. The example embodiments of a stepped profile may include a "pilot" section of nominal length L2. The example mill 10 in FIG. 7 has a single diameter pilot section, the diameter being d(min); in this example d(min) and d(int) may be the same, or d(int) may be defined on the tapered portion of the profile provided that the longitudinal position of d(int) is at least the distance L2 from the end of the mill 10. The example in FIG. 8 may include successively larger diameter sections, beginning with d(min) and terminating at d(int) at an axial distance L2 from the end of the mill 10.

Figure 5:
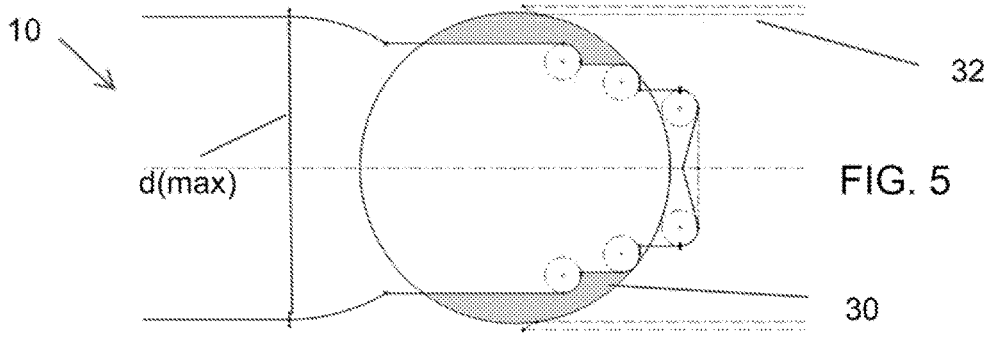
Figure 6:
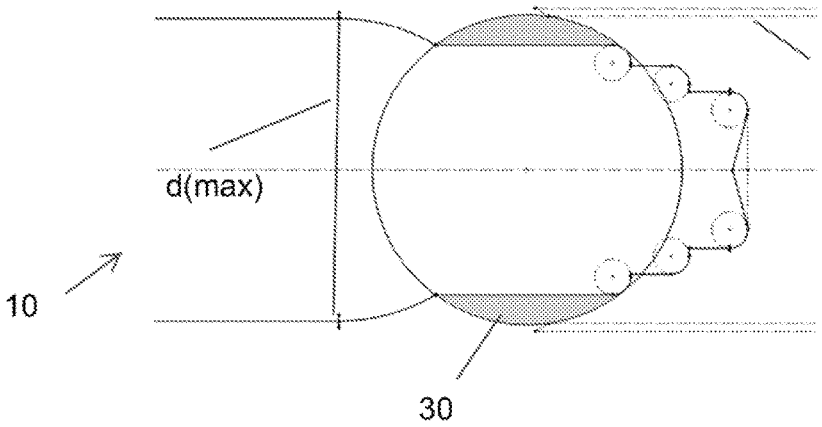

It has been determined through experimentation that milling drop balls with a conventional profile mill may result in large portions of uncut drop ball material passing through the ball seat to axial position of the next drop ball (frac stage). Such uncut material may be difficult to mill when it is in contact with another drop ball. By creating a profile that allows the mill to completely penetrate and mill the center of the drop ball 30 before the drop ball 30 ball can be pushed through to the next frac stage is believed to result in the uncut drop ball material consisting of much smaller fragments. Such smaller fragments may facilitate the milling operation, especially when the drop balls 30 are made from solid metal. FIGS. 5 and 6 show, respectively, penetration of the mill 10 through the drop ball 30 by successively larger diameter sections to effect the milling of the drop ball as described above. The foregoing dimensions, L2, d(min) and d(int) may also apply to the ballistic profile shown in FIGS. 2 and 3.

In other embodiments, combinations of stepped diameter profile as shown in with a ballistic profile may be used. Example embodiments of such profiles are shown in FIGS. 7 and 8.

A mill made according to various aspects of the present disclosure may provide increased milling efficiency by the use of shear cutters, for example, PDC shear cutters, while reducing breakage thereof by shock loading by the use of gouging type cutters rotationally ahead of the shear cutters on one or more blades. Such gouging type cutters may be disposed at a selected lateral distance from the center of rotation of the mill body because of the expected structure of the equipment to be milled from a wellbore using a mill according to the present disclosure. Correspondingly, shear cutters may be disposed proximate the center of rotation because of the expected equipment to be milled using a mill according to the present disclosure without substantial risk of breakage of the shear cutter(s) so located by reason of shock loading.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A mill, comprising:

a mill body defining a plurality of blades extending in a direction from a center of rotation of the mill body to a gage surface, the blades defining a cutting profile having a minimum diameter at a longitudinal endmost position, the minimum diameter smaller than a diameter of a drop ball, the cutting profile having an intermediate diameter at most equal to the diameter of the drop ball at a longitudinal distance from the endmost position greater than the diameter of the drop ball;

shear cutters mounted on at least one of the plurality of blades, the shear cutters being mounted such that at least one shear cutter is mounted closer to a center of rotation of the mill body with respect to other cutters mounted to the at least one of the blades; and at least one insert mounted to the at least one of the plurality of blades rotationally ahead of the shear cutters.

2. The mill of claim 1 wherein the shear cutters and the at least one insert define a cutter surface smaller in diameter than a gage diameter defined by a laterally outermost surface of the plurality of blades.

3. The mill of claim 1 wherein the shear cutters comprise at least one of polycrystalline diamond compact cutters, carbide cutters and cubic boron nitride cutters.

4. The mill of claim 1 wherein the at least one insert comprises a gouging cutter.

5. The mill of claim 4 wherein the gouging cutter is conically shaped.

6. The mill of claim 1 wherein the at least one insert is made from tungsten carbide.

7. The mill of claim 1 wherein at least one of the shear cutters comprises a tungsten carbide cutter.

8. The mill of claim 1 wherein the profile comprises a ballistic profile.

9. The mill of claim 1 wherein the profile comprises a stepped diameter profile.

10. The mill of claim 1 wherein the profile comprises a combination stepped diameter profile and ballistic profile.

11. A mill, comprising:

a mill body defining a plurality of blades extending in a direction from a center of rotation of the mill body to a gage surface, the blades defining a cutting profile having a minimum diameter at a longitudinal endmost position;

shear cutters mounted on at least one of the plurality of blades, the shear cutters being mounted such that at least one shear cutter is mounted closer to a center of rotation of the mill body with respect to other cutters mounted to the at least one of the blades; and at least one insert mounted to the at least one of the plurality of blades rotationally ahead of the shear cutters.

12. The mill of claim 11 wherein the shear cutters and the at least one insert define a cutter surface smaller in diameter than a gage diameter defined by a laterally outermost surface of the plurality of blades.

13. The mill of claim 11 wherein the shear cutters comprise at least one of polycrystalline diamond compact cutters, carbide cutters and cubic boron nitride cutters.

14. The mill of claim 11 wherein the at least one insert comprises a gouging cutter.

15. The mill of claim 14 wherein the gouging cutter is conically shaped.

16. The mill of claim 11 wherein the at least one insert is made from tungsten carbide.

17. The mill of claim 11 wherein at least one of the shear cutters comprises a tungsten carbide cutter.

18. The mill of claim 11 wherein the profile comprises a ballistic profile.

19. The mill of claim 11 wherein the profile comprises a stepped diameter profile.

20. The mill of claim 11 wherein the profile comprises a combination stepped diameter profile and ballistic profile.

* * * * *